US008884997B2

(12) United States Patent
Pallakoff

(10) Patent No.: US 8,884,997 B2
(45) Date of Patent: Nov. 11, 2014

(54) SYSTEM AND METHOD FOR LOW-FLASH VEIL ON AN ELECTRONIC PAPER DISPLAY

(75) Inventor: Matt Pallakoff, Mountain View, CA (US)

(73) Assignee: barnesandnoble.com llc, New York, NY (US)

( * ) Notice: Subject to any disclaimer, the term of this patent is extended or adjusted under 35 U.S.C. 154(b) by 74 days.

(21) Appl. No.: 13/476,821

(22) Filed: May 21, 2012

(65) Prior Publication Data

US 2012/0299975 A1 Nov. 29, 2012

Related U.S. Application Data

(60) Provisional application No. 61/489,208, filed on May 23, 2011.

(51) Int. Cl.
*G09G 5/10* (2006.01)
*G09G 3/34* (2006.01)

(52) U.S. Cl.
CPC ..... *G09G 3/344* (2013.01); *G09G 2320/0247* (2013.01); *G09G 2320/0626* (2013.01); *G09G 2310/04* (2013.01)
USPC ..... 345/690; 345/87; 345/214

(58) Field of Classification Search
USPC ..... 345/107–111, 690, 214, 87
See application file for complete search history.

(56) References Cited

U.S. PATENT DOCUMENTS

| | | | | |
|---|---|---|---|---|
| 5,254,981 | A | 10/1993 | Disanto et al. | 345/107 |
| 6,407,759 | B1 | 6/2002 | Kanungo et al. | 345/809 |
| 2006/0101293 | A1 | 5/2006 | Chandley et al. | 713/300 |
| 2006/0232531 | A1 | 10/2006 | Amundson et al. | 345/87 |
| 2008/0129667 | A1 * | 6/2008 | Zehner et al. | 345/87 |
| 2008/0165120 | A1 | 7/2008 | Johnson | 345/107 |
| 2008/0309657 | A1 * | 12/2008 | Rhodes et al. | 345/214 |

* cited by examiner

*Primary Examiner* — Premal Patel
(74) *Attorney, Agent, or Firm* — Winston & Strawn LLP

(57) ABSTRACT

A system and method for controlling a user interface display that de-emphasizes a background image of a physical display. The system and method draws a pattern, preferably a checkered pattern, of black and transparent pixels over the background image. The system and method mitigates any jarring effect of the prior art of driving all of the display to black. Although in the preferred embodiment, the checkered pattern alternates pixels between black and transparent, any pattern that drives less than substantially all of the pixels to black is suitable.

18 Claims, 8 Drawing Sheets undergraduate at the Massachusetts Institute of Technology, his mother had implored him to take at least one history course. The brilliant young economist replied cockily that he was more interested in the future than in the past. It is a preference he now knows to be illusory. There is in fact no such thing as the future, singular; only futures, plural. There are multiple interpretations of history, to be sure, none definitive – but there is only one past. And although the past is over, for two reasons it is indispensable to our understanding of what we experience today and what lies ahead of us tomorrow and thereafter. First, the current world population makes up approximately 7 per cent of all the human beings who have ever lived. The dead outnumber the living, in other words, fourteen to one, and we ignore the accumulated experience of such a huge majority of mankind at our peril. Second, the past is really our only reliable source of knowledge about the fleeting present and to 14 of 410

100

FIGURE 1
PRIOR ART undergraduate at the Massachusetts Institute of Technology, his mother had implored him to take at least one history course. The brilliant young economist replied cockily that he was more interested in the future than in the past. It is a preference he now knows to be illusory. There is in fact no such thing as the future, singular; only futures, plural. There are multiple interpretations of history, to be sure, none definitive – but there is only one past. And although the past is over, for two reasons it is indispensable to our understanding of what we experience today and what lies ahead of us tomorrow and thereafter. First, the current world population makes up approximately 7 per cent of all the human beings who have ever lived. The dead outnumber the living, in other words, fourteen to one, and we ignore the accumulated experience of such a huge majority of mankind at our peril. Second, the past is really our only reliable source of knowledge about the fleeting present and to 14 of 410

100

FIGURE 3
PRIOR ART

SYSTEM AND METHOD FOR LOW-FLASH VEIL ON AN ELECTRONIC PAPER DISPLAY

CROSS-REFERENCE TO RELATED APPLICATION

This application claims benefit of U.S. Provisional Application No. 61/489,208, filed May 23, 2011, which is hereby incorporated by reference.

FIELD OF THE INVENTION

The present invention generally relates to systems and methods for operating a screen display on an electronic paper display and more particularly to systems and methods for veiling a background image on an electronic paper display without jarring screen changes.

BACKGROUND OF THE INVENTION

On hand-held devices with modern color Liquid Crystal Display (LCD) and Organic Light Emitting Diode (OLED) displays, it is a fairly common User Interface (UI) technique to temporarily dim the background screen when bringing up a temporary dialog, panel, or set of selectable elements over the background screen. This feature appears as a semi-transparent "veil" that has been drawn over the background screen. The net effect is to darken the pixels in the background screen so the white pixels become gray and the gray pixels become darker gray. The active dialog, panel, or set of selectable elements are contained in a non-full-screen-sized window that contains an area of user interactivity. Along this active window's border and in the background, the underlying window that was present before the dialog was brought up is partially occluded. In general practice, the occluding along the border and in the background is often achieved with an alpha mask, that serves to darken/obscure the background window, drawing the user's attention to the foreground dialog.

Dimming the background helps users focus on the new foreground elements that have just appeared over the background, and let the user know that the background elements are not active while the new foreground elements are active.

The most common type of Electronic Paper Display (EPD) is formed using electrophoretic technology. In this technology, particles, typically titanium dioxide (titania) particles approximately one micrometer in diameter are dispersed in a hydrocarbon oil. A dark-colored dye is also added to the oil, along with surfactants and charging agents that cause the particles to take on an electric charge. This mixture is placed between two parallel, conductive plates separated by a gap of 10 to 100 micrometers. When a voltage is applied across the two plates, the particles will migrate electrophoretically to the plate bearing the opposite charge from that on the particles. When the particles are located at the front (viewing) side of the display, it appears white, because light is scattered back to the viewer by the high-index titania particles. When the particles are located at the rear side of the display, it appears dark, because the incident light is absorbed by the colored dye. If the rear electrode is divided into a number of small picture elements, pixels, in an active matrix grid, then an image can be formed by applying the appropriate voltage to each region of the display to create a pattern of reflecting and absorbing regions.

In an alternative embodiment, an electrophoretic display can use tiny microcapsules filled with electrically charged white particles suspended in a colored oil. In some versions, the underlying circuitry controls whether the white particles were at the top of the capsule (so it looked white to the viewer) or at the bottom of the capsule (so the viewer saw the color of the oil). This use of microcapsules allows the display to be used on flexible plastic sheets instead of glass.

EPD displays provide several advantages over other display types, such as LCD but exhibit poor performance and clarity under certain circumstances, notably screen updates. A screen update involves a transition on a subset of the x-y pixels in the display, denoted as 'pixel transitions.' In other words, a pixel transition is the change of the color value (or grayscale value) of a pixel at a given x-y address. Due to the underlying physical mechanism that EPDs use for display (pigmented substances that travel vertically through a liquid medium as a response to electrical fields in the x-y neighborhood of the pixel), unpleasant visual errors and artifacts in that neighborhood are often the by-product of a pixel transition. This is especially the case with pixel transitions that involve non-black/non-white values, either as the source or target member of the transition pair.

On an EPD screen, a typical method of creating the veil is to first drive all of the pixel to black, and then recharge them to the gray color. The reason this was done is that shifting from one shade of gray to a different, darker, shade of gray is unreliable. Specifically, the charged particles in a given pixel, do not necessarily respond as desired to a small incremental change in the charge of the electrodes controlling the pixel. Driving the pixels all the way to black or white, and then back to the desired shade of gray is much more reliable process. This process is illustrated in FIGS. 1-3.

An exemplary User Interface ("UI") screen displayed on an EPD device 100 is illustrated in FIG. 1. As shown in FIG. 2, a dialog box 110 is displayed on the EPD device 100 with areas that are selectable by the user. At the same time as the dialog box 110 is displayed, the previous image, which now appears as a background image, is darkened by a veil 120 in order to highlight the dialog box 110 to the user. As described above, in order to reliably draw the veil 120 over the background image, the system briefly forces every pixel to a full black or full white state, as shown in FIG. 3, before the pixels that will wind up being gray are made gray as in FIG. 2. This brief transition states lasts roughly a half second on typical EPD devices. Most pixels on a page of text tend to be white, and those pixels generally get forced to black, so this brief transition state appears as a "black flash".

SUMMARY OF THE INVENTION

The present inventors have discovered that the reset of the entire display to black causes a jarring flash of black on the screen before the veil appears. This reset to black causes an unpleasant experience for the user, detracting from the reading experience. The same technique of driving the display to black is also performed after a predetermined number of "page turns" of an eBook in order to remove artifacts that build up over time.

The present invention solves the problem of the jarring black screen by driving the veiled portion of the display screen in an alternating black and transparent checkerboard pattern. Specifically, certain pixels, or pattern of pixels (preferably square) is driven black, while all of its neighboring pixels or areas of pixels, are left alone, i.e., the original state of the pixel is not changed.

This method of creating the veil mitigates the problems of the prior art in that the entire screen is not driven completely black (or white) and the jarring flash does not occur. However, the end result of the system and method of the present invention is that overall visual appearance of the veiled portion of the display is the desired gray.

BRIEF DESCRIPTION OF THE DRAWINGS

For the purposes of illustrating the present invention, there is shown in the drawings a form which is presently preferred, it being understood however, that the invention is not limited to the precise form shown by the drawing in which:

FIG. 1 depicts a prior art user interface on an EPD device before a veil is applied;

FIG. 3 illustrates the prior art method of driving the display to black prior to drawing the veil;

DETAILED DESCRIPTION OF THE INVENTION

In contrast to LCD or OLED screens, in today's grayscale (i.e., non-color) EPD displays, whenever user-interface software changes a pixel color to any non pure black or white color (i.e., to a shade of gray between black and white), the display normally must first briefly change the pixel to fully black before making it gray in order to properly set the gray level. Alternative, the system could drive the pixels to their fully "white" state and then transition to the desired "gray" level. Although there are modes that avoid this "flash" to black (or white), these modes result in lower quality images. Thus, if the system driving the display darkens substantially all of the background pixels, these background pixels will first appear to flash to black before settling to their respective shades of gray. The whole screen appears to briefly flash to black before the new veiled state appears. This flash to black is fairly quick, roughly half a second, but it is visually jarring to the user.

For this reason, many devices, e.g., electronic book readers, that use EPD devices tend to avoid this "veil" UI technique. In one embodiment, they avoid the jarring black flash by not creating any veil of the background image at all. However in doing so, they lose the benefits of the veil technique described above, i.e., helping the user focus on the new active elements, and helping the user understand that background elements are temporarily inactive.

One significant advantage of the present invention over the prior art is that it allows EPD based user interfaces to generate this veil effect (i.e., the illusion of dimming the background screen) while eliminating the jarring black flash.

Figure 4:
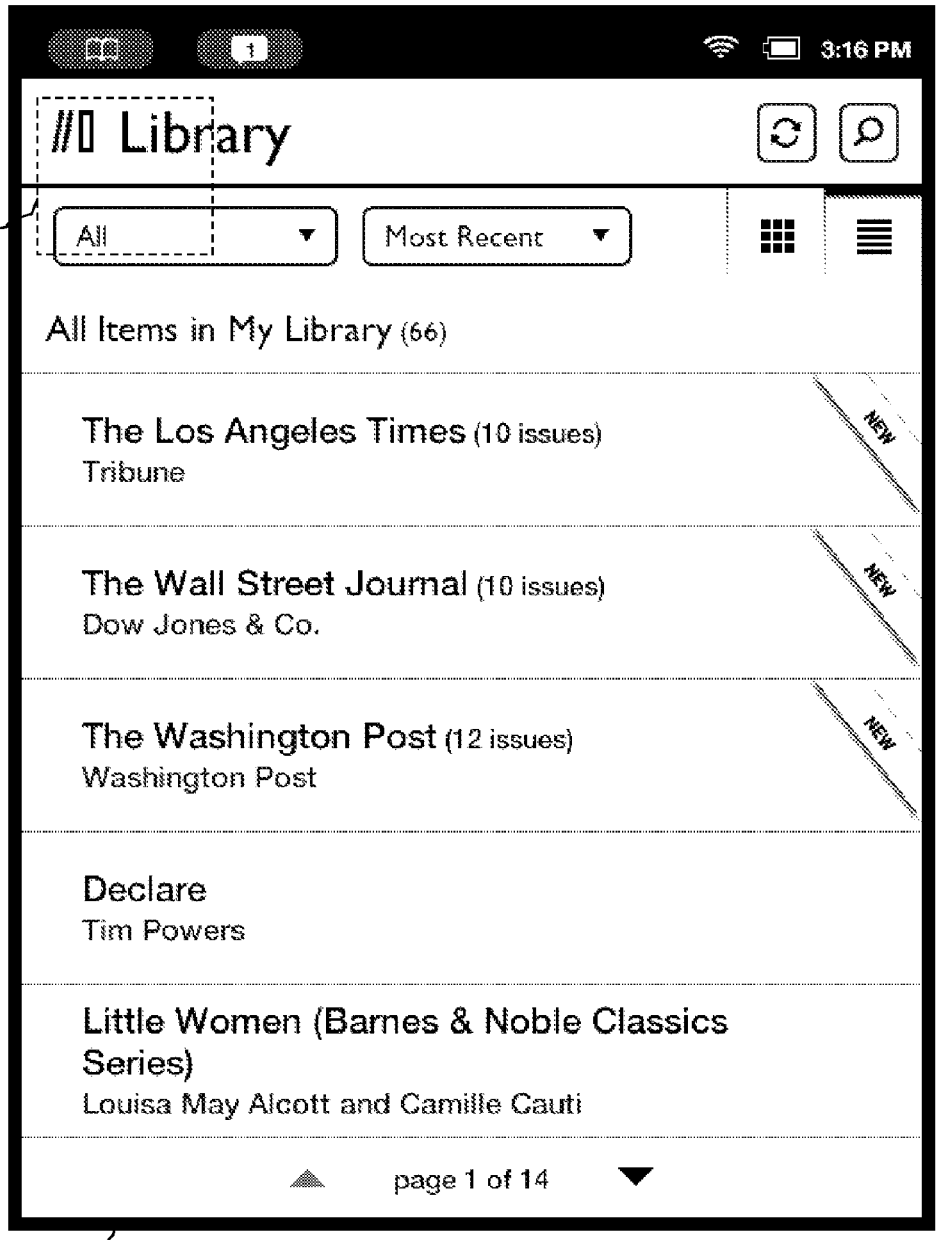
FIGURE 4 PRIOR ART
FIG. 4 illustrates a user interface screen on an EPD device before the veil of the present invention is applied.

FIG. 4 illustrates an example of a user interface screen on and EPD device 200 before an active dialog box is brought up and before the veil of the present invention is applied.

In a preferred embodiment of the present invention, rather than darkening every pixel in the background screen (for example, by overlaying a semi-transparent solid color), the preferred embodiment draws a checkered pattern "veil" of black and clear (i.e., completely transparent) pixels over the background screen.

Figure 5:
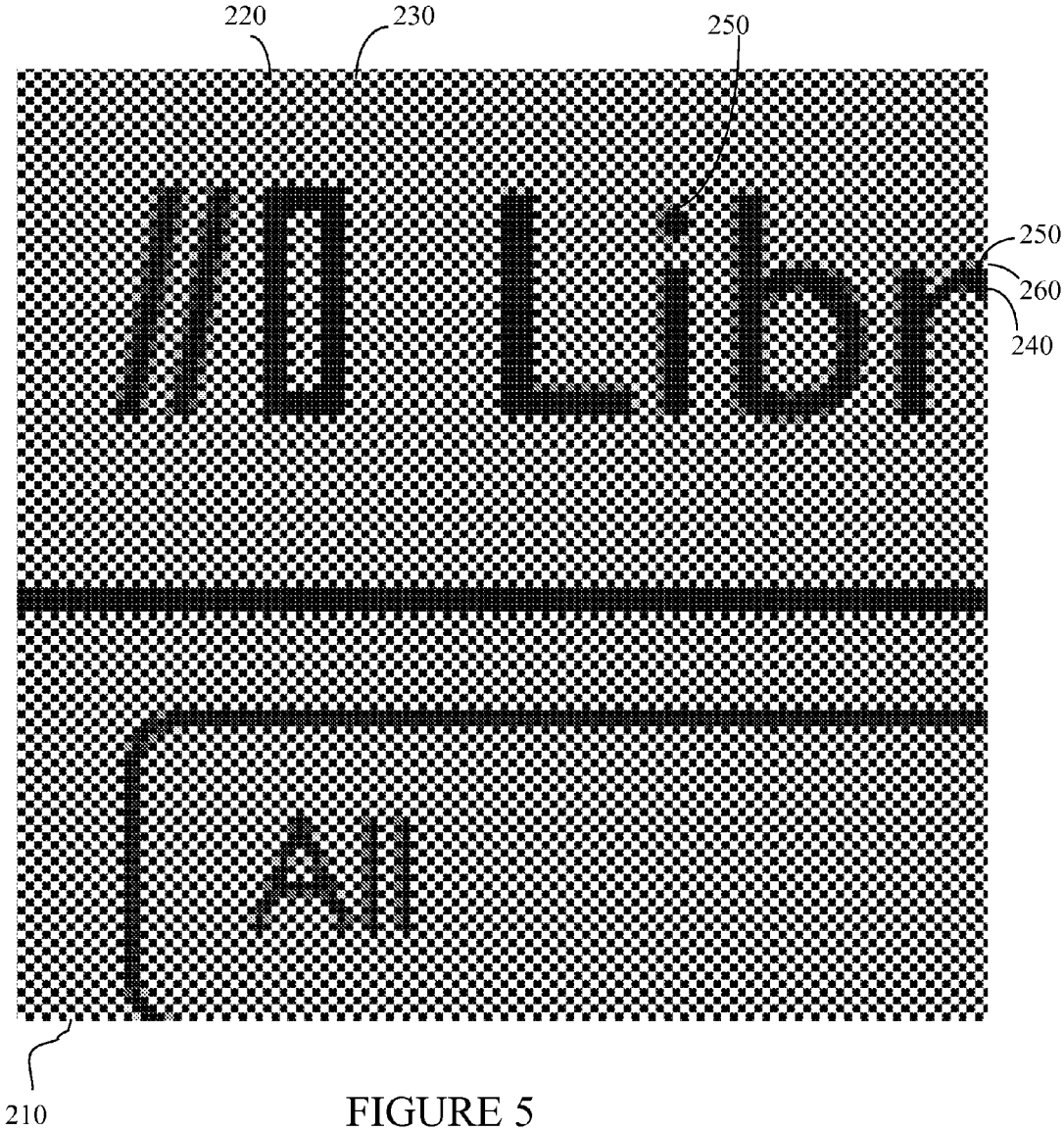
FIG. 5 is an enlarged portion of the user interface on the EPD device of FIG. 2 illustrating the veil checker board of the present invention.

FIG. 5 illustrates the checkered pattern of an embodiment of the present invention. Area 210 as illustrated in FIG. 5 is a portion of the image displayed on the user interface screen on the EPD device 200 illustrated in FIG. 4, but after the veil of the present invention has been applied. As appreciated by those skilled in the art, the same techniques described with respect to area 210 are applied to the remainder of the user interface image on the EPD device 200.

In a preferred embodiment, the checkered pattern of the present invention is performed on a pixel by pixel basis. However, other patterns of pixels can be used, for example a two by two square of pixels. As show in the area 210 depicted in FIG. 5, the system and method of the present invention applies alternating black 220 and transparent 230 states to each of the pixels on the EPD device 200. That is to say, the system and method drives every other pixel to the pure black state 220 and leaves every other pixel 230 in the same state as before the checkered veil process is applied. In the case of pixel 230, this pixel was previous white, and remains white after the checkered veil process. In the case of pixel 220, this pixel was previous white, but is turned black after the checkered veil process. The checkered veil of the present invention can be thought of as a dithering mask where every pixel in the mask is either pure black or fully transparent.

Similarly, in the area of the letter "r" 240 depicted in area 210, the black pixels constituting the letter "r" are either re-driven black by the process, or are left alone with a transparent state. Certain white pixels bordering the black pixels constituting the letter "r" are driven black 250, while other of the white pixels bordering the black pixels constituting the letter "r" remain white 260.

Figure 2:
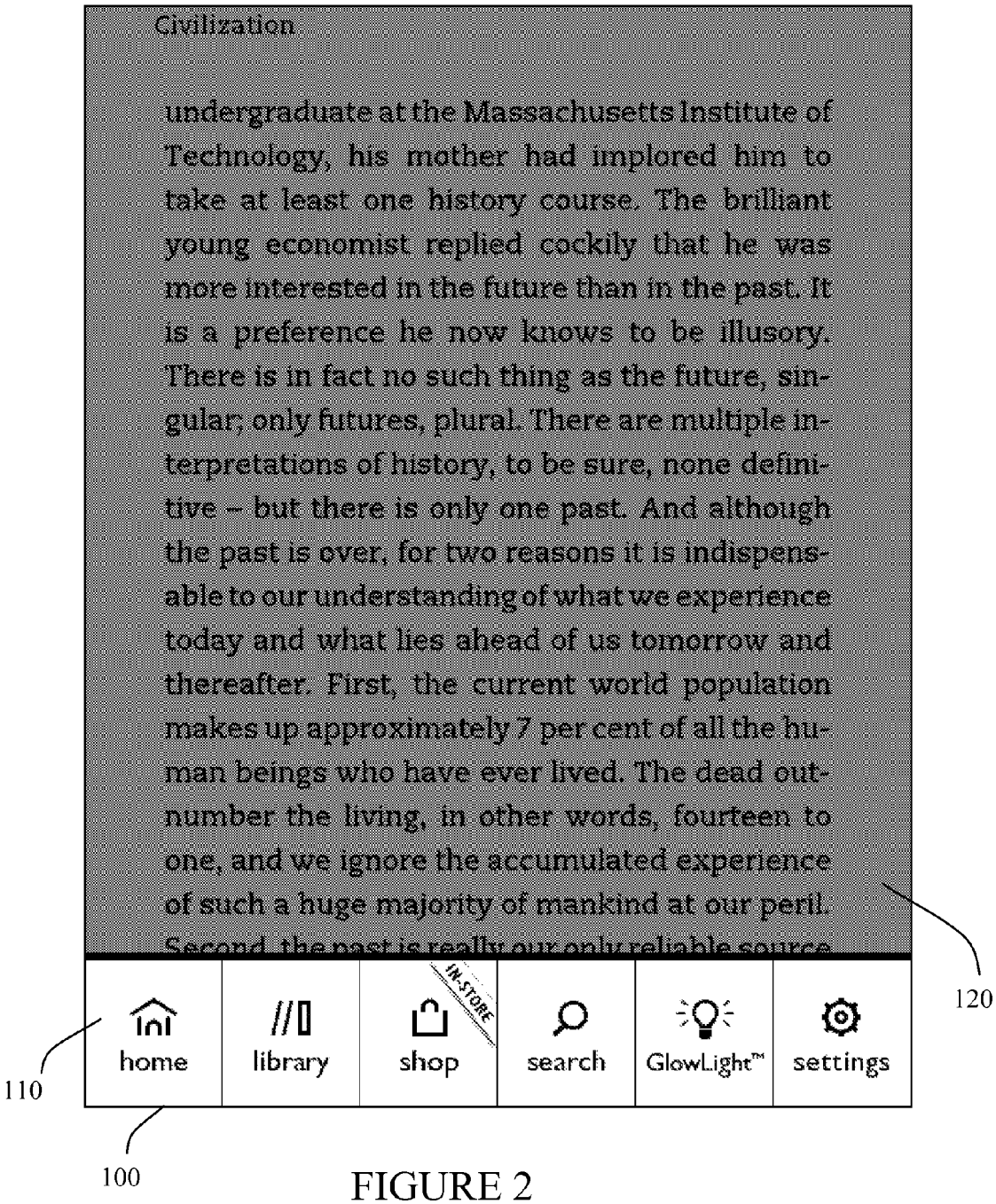
FIGURE 2 PRIOR ART
FIG. 2 illustrates the prior art user interface on the EPD device after the veil has been applied and an active dialog box is displayed.
Figure 6:
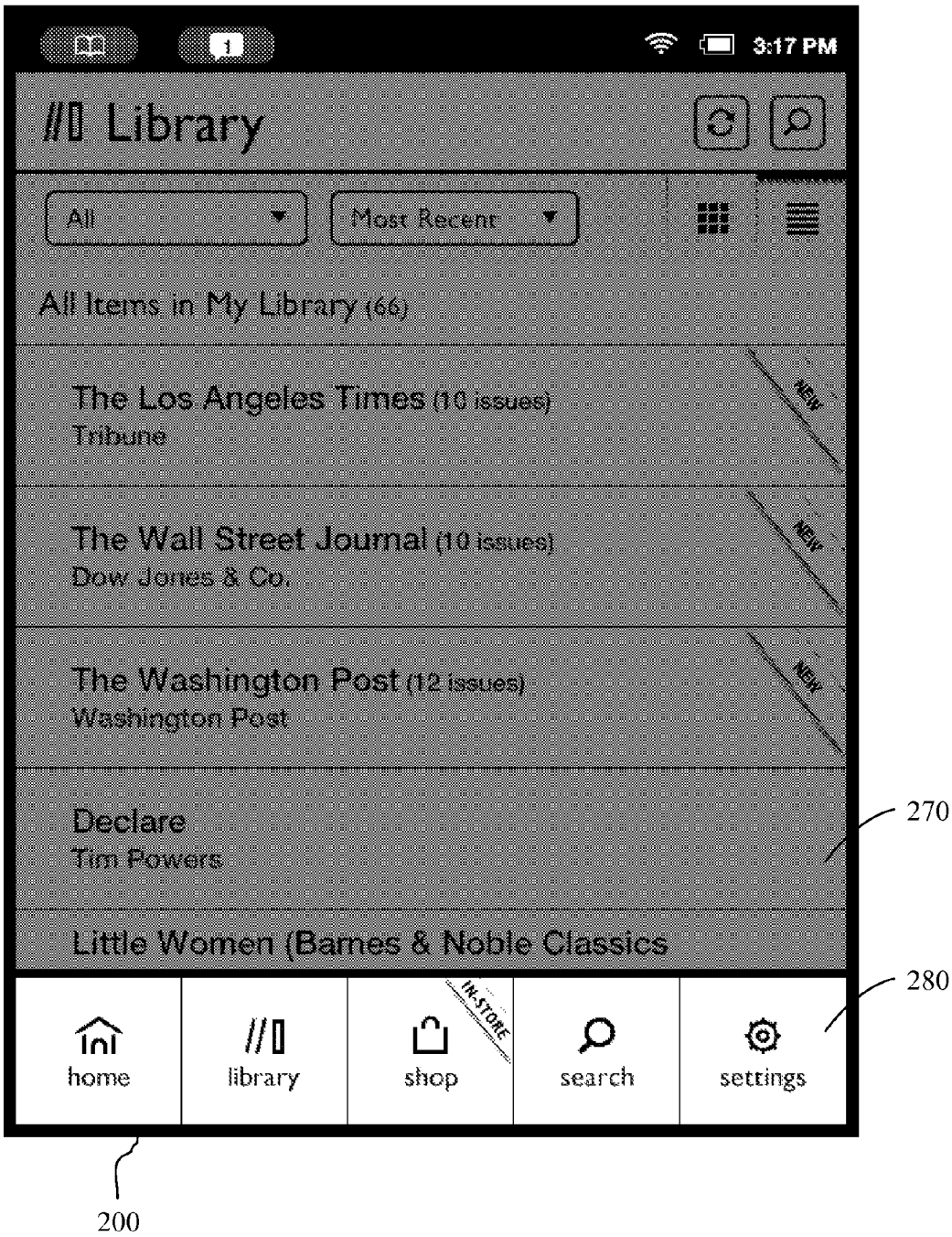
FIG. 6 depicts the user interface screen on the EPD device with the veil of the present invention applied, and with a dialog box displayed without the veil.

The end result of the veiling process of the system and method the present invention is illustrated in FIG. 6. As shown in FIG. 6, the previous image displayed in the EPD device 200 appears darker, with a veil 270 drawn over it, while the active dialog box 280 is drawn without the veil to highlight the portions selectable by the user on the user interface displayed on the EPD device 200. The visual appearance resulting from the checkered process of the present invention illustrated in FIG. 6 is similar to the prior art result illustrated in FIG. 2. However, as explained above, the process by which this result is achieved is completely different.

In a worst case, the process of the present invention results in half of the background pixels on the EPD device being changed to pure black (not to gray) which avoids flashing those pixels to black and then back to gray. And when the eInk display driver is set to an appropriate update mode, the other half of the background pixels do not change at all, since they are under clear pixels in the checker-board veil. In practice, since most images that are being veiled by the process of the present invention already contain a significant number of already black pixels, the number of gray or white pixels that are transitioned to black is closer to one-fifth of the pixels on the EPD device 200.

Other embodiments of the veil or overlaying screen can consist of a wide range of patterns, arrangements, or even random distributions of black, clear (i.e. completely transparent), and potentially white pixels. An important factor is that the overlaying screen should not contain gray pixels (i.e., pixels that are a shade of gray between pure black and pure white), because that would make grayscale EPD devices flash those pixels to black (or potentially white) before they turn gray, introducing the jarring extra flash. In this context "gray pixels" means not white, black, or completely transparent. If the veil, mask, has any semi-transparent pixels (not white, black, or transparent), then that will change the color of the underlying pixel, thus resulting in the undesired flash.

As described above, the present invention is not limited to the checkered patterns of alternating black and transparent pixels for the veil mask. For example, a designer could choose to design a veil consisting of a more interesting pattern of black and clear pixels than a simple checkered pattern. In accordance with the present invention, a designer could, for example, make a veil with a paisley pattern, and as long as it did not contain any gray pixels, it would avoid the extra flash.

The present invention can be applied to a full screen of EPD device 200, or to substantial subset of the screen, or to a small portion of the screen, including to a relatively small UI element such as a button's downstate. For example, one could have a button appear to dim when pressed by overlaying a veil that is basically the size and shape of the button (plus or minus the border) where the veil consists of a checkered pattern or other pattern of black and clear pixels (or other combination of non gray pixels).

There may be some form of flash when the veil is later removed and the background image restored. Since there will usually be some gray pixels in the original background screen image, in order to reliably draw that gray pixel, the system can first drive the pixels to black and then back to the desired gray color. Alternatively, the system can apply the concepts of the present invention and drive the entire screen with a full black and full white checkerboard pattern before drawing the new screen with black white and gray pixels. This process can be applied when the system occasionally, e.g., after a certain number of page turns, must reset the pixels to remove built up artifacts.

The present invention's process of reducing the black flash when the veil comes up, provides a significant improvement in the user experience in contrast to the flashing black of the prior art whenever the veil comes up.

Figure 7:
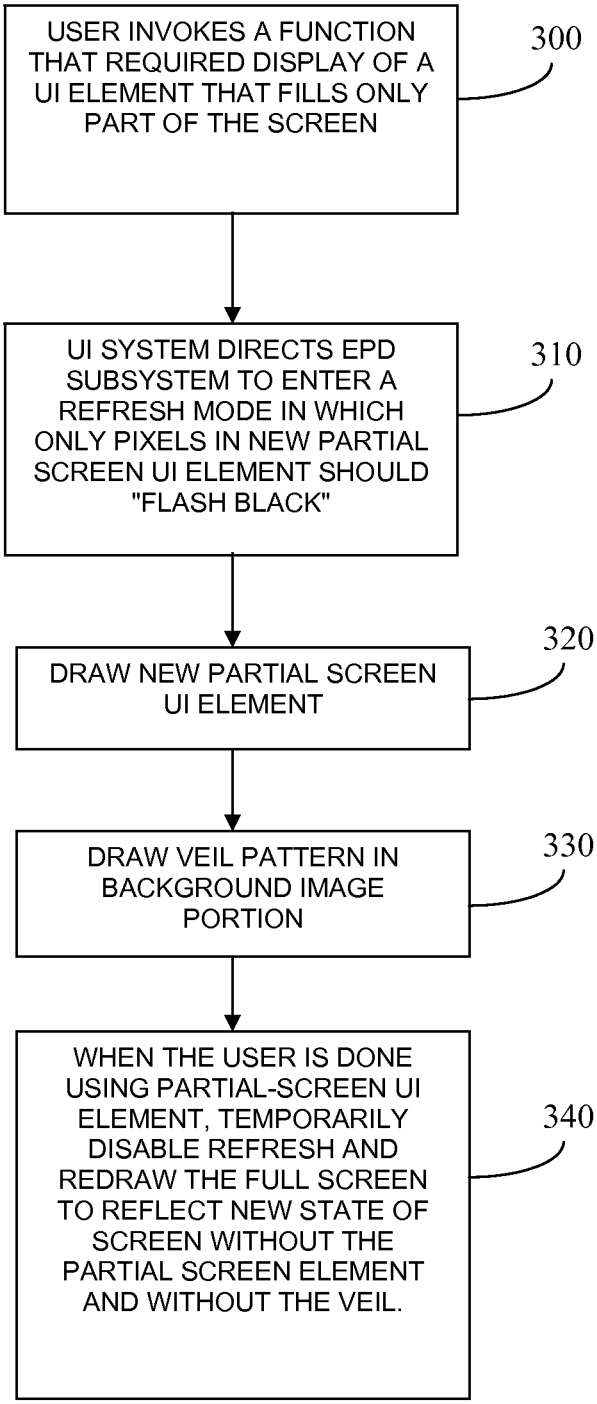
FIG. 7 illustrates a flowchart for an exemplary process according to the present invention.

FIG. 7 depicts an exemplary process that incorporates the veiling method of the present invention. In step 300, the user has invoked a function that will (in step 320) reveal a UI element that fills only part of the screen. An example of such a UI element is the dialog box 280 illustrated in FIG. 6. Typically, this partial screen UI element is something that requires the user's input, for example the selection of a function incorporated in the UI element.

In step 310, the UI subsystem, typically a software subsystem, instructs the EPD subsystem to enter a refresh mode in which only the pixels that are contained the partial screen UI element should be driven to black. A previously described, the purpose of "flash black" of these pixels is enable a reliable drawing of the new image in the partial screen UI element, which presumable would contain at least some gray pixels.

In step 320, with the pixels in the partial screen UI element driven to black, the system is able to reliably draw the new UI element with its target shades.

In step 330, the system draws the veil of black and transparent pixels, as described above, over the rest of the screen to create a dimmed background image. Again, the veil is preferably drawn in checkerboard pattern of black and transparent pixels.

In step 340, when the user is done performing whatever action is required on the partial-screen UI element, the EPD subsystem temporarily disables its normal refresh routine. The UI subsystem then directs the EPD subsystem to draws the full screen to reflect whatever new state it should be in. For example, the action taken by the user on the partial screen UI element might necessitate an entirely new screen. The new screen is drawn without the partial screen UI element and without the veil.

In an alternative embodiment, steps 330 and 310-320 can be reversed. Namely, the background image can first be veiled using the techniques of the present invention (step 330), then the new partial screen UI element can be drawn (steps 310-320).

Figure 8:
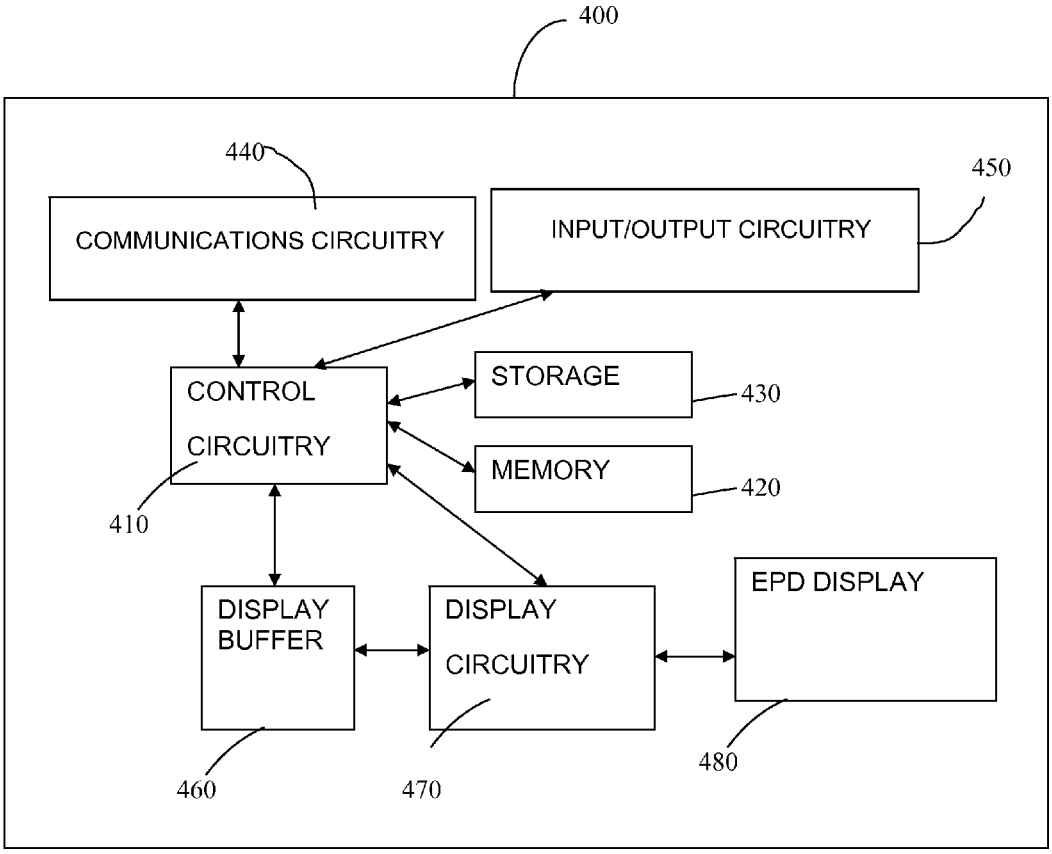
FIG. 8 depict an exemplary device incorporating the present invention.

FIG. 8 illustrates a system 400 according to the present invention. As appreciated by those skilled the art, the system 400 can take many forms capable of operating the present invention. In a preferred embodiment the system 400 is a mobile electronic device, and in an even more preferred embodiment, the system 400 is an electronic reader device. The system 400 can include control circuitry 410, storage 430, memory 420, input/output ("I/O") circuitry 450, communications circuitry 440, display buffer 460, display circuitry 470 and an EPD device 480. In some embodiments, one or more of the components of system 400 can be combined or omitted, e.g., storage 430 and memory 420 may be combined. As appreciated by those skilled in the art, system 400 can include other components not combined or included in those shown in FIG. 8, e.g., a power supply such as a battery, an input mechanism, etc.

System 400 can include any suitable type of electronic device. For example, system 400 can include a portable electronic device that the user may hold in his or her hand, such as a digital media player, a personal e-mail device, a personal data assistant ("PDA"), a cellular telephone, a handheld gaming device, a tablet device or an eBook reader. As another example, system 400 can include a larger portable electronic device, such as a laptop computer. As yet another example, system 400 can include a substantially fixed electronic device, such as a desktop computer.

Control circuitry 410 can include any processing circuitry or processor operative to control the operations and performance of system 400. For example, control circuitry 410 can be used to run operating system applications, firmware applications, media playback applications, media editing applications, or any other application. Control circuitry 410 can drive the display 480 and process inputs received from a user input interface.

Storage 430 can include, for example, one or more storage mediums including a hard-drive, solid state drive, flash memory, permanent memory such as ROM, any other suitable type of storage component, or any combination thereof. Storage 430 can store, for example, media content, e.g., eBooks, music and video files, application data, e.g., software for implementing functions on system 400, firmware, user preference information data, e.g., content preferences, authentication information, e.g. libraries of data associated with authorized users, transaction information data, e.g., information such as credit card information, wireless connection information data, e.g., information that can enable system 400 to establish a wireless connection), subscription information data, e.g., information that keeps track of podcasts or television shows or other media a user subscribes to, contact information data, e.g., telephone numbers and email addresses, calendar information data, and any other suitable data or any combination thereof.

Memory 420 can include cache memory, semi-permanent memory such as RAM, and/or one or more different types of memory used for temporarily storing data. In some embodiments, memory 420 can also be used for storing data used to operate electronic device applications, or any other type of data that can be stored in storage 430. In some embodiments, memory 420 and storage 430 can be combined as a single storage medium.

I/O circuitry 450 can be operative to convert, and encode/decode, if necessary analog signals and other signals into digital data. In some embodiments, I/O circuitry 450 can also convert digital data into any other type of signal, and vice-versa. For example, I/O circuitry 450 can receive and convert physical contact inputs, e.g., from a multi-touch screen (which can be incorporated into EPD display 480), physical movements, e.g., from a mouse or sensor, analog audio signals, e.g., from a microphone, or any other input. The digital data can be provided to and received from control circuitry 410, storage 430, and memory 420, or any other component of system 400. Although I/O circuitry 450 is illustrated in FIG. 8 as a single component of system 400, several instances of I/O circuitry 450 can be included in system 400.

System 400 can include any suitable interface or component for allowing a user to provide inputs to I/O circuitry 450. For example, system 400 can include any suitable input mechanism, such as a button, keypad, dial, a click wheel, or a touch screen, e.g., incorporated in EPD device 480. In some embodiments, system 400 can include a capacitive sensing mechanism, or a multi-touch capacitive sensing mechanism.

In some embodiments, system 400 can include specialized output circuitry associated with output devices such as, for example, one or more audio outputs. The audio output can include one or more speakers, e.g., mono or stereo speakers, built into system 400, or an audio component that is remotely coupled to system 400, e.g., a headset, headphones or earbuds that can be coupled to system 400 with a wire or wirelessly.

Display buffer 460, display circuitry 470 and EPD device 480 include the display and display circuitry for providing a display visible to the user. In some embodiments, the display circuitry 470 can include a coder/decoder (Codec) to convert digital media data into analog signals. For example, the display circuitry 470 or other appropriate circuitry within system 400 can include video Codecs, audio Codecs, or any other suitable type of Codec.

The display circuitry 470 also can include display driver circuitry, circuitry for driving display drivers, or both. The display circuitry 470 can be operative to display content, e.g., media playback information, application screens for applications implemented on the system 400, information regarding ongoing communications operations, information regarding incoming communications requests, or device operation screens, under the direction of control circuitry 460. As appreciated by those skilled in the art, the control circuitry writes new data that is to be displayed to display buffer 460. Display circuitry 470 takes this pixel data and writes it to the EPD display 480 for updating the images displayed thereon as described above.

Communications circuitry 440 can include any suitable communications circuitry operative to connect to a communications network and to transmit communications, e.g., data from system 400 to other devices within the communications network. Communications circuitry 440 can be operative to interface with the communications network using any suitable communications protocol such as, for example, Wi-Fi, e.g., a 802.11 protocol, Bluetooth, radio frequency systems, e.g., 900 MHz, 1.4 GHz, and 5.6 GHz communication systems, infrared, GSM, GSM plus EDGE, CDMA, quadband, and other cellular protocols, VOIP, or any other suitable protocol.

System 400 can include one more instances of communications circuitry 440 for simultaneously performing several communications operations using different communications networks, although only one is shown in FIG. 7 to avoid overcomplicating the drawing. For example, system 400 can include a first instance of communications circuitry 440 for communicating over a cellular network, and a second instance of communications circuitry 440 for communicating over Wi-Fi or using Bluetooth. In some embodiments, the same instance of communications circuitry 440 can be operative to provide for communications over several communications networks.

In some embodiments, system 400 can be coupled to a host device such as digital content control server for data transfers, synching the communications device, software or firmware updates, providing performance information to a remote source, or performing any other suitable operation that can require system 400 to be coupled to a host device. Several systems 400 can be coupled to a single host device using the host device as a server. Alternatively or additionally, system 400 can be coupled to several host devices, e.g., for each of the plurality of the host devices to serve as a backup for data stored in system 400.

Although the present invention has been described in relation to particular embodiments thereof, many other variations and other uses will be apparent to those skilled in the art. It is preferred, therefore, that the present invention be limited not by the specific disclosure herein, but only by the gist and scope of the disclosure.

What is claimed is:

1. A process for controlling an electronic paper display (EPD), the EPD comprising a plurality of pixels, the process comprising the acts of:

determining an initial state of each of the plurality of pixels of the EPD;

driving a pattern of less than all of the plurality of pixels of the EPD to a black state, wherein pixels which are not driven to the black state retain their initial state, and wherein the pixels driven to the black state and the pixels that retain their initial state form a background image; and drawing a new image over a portion of the background image, the pixels comprising the new image containing pixel states that are different from their initial states.

2. The process according to claim 1, wherein the act of driving the pattern of less than all of the plurality of pixels of the EPD to the black state further comprises driving alternating pixels to the black state.

3. The process according to claim 1, wherein the background image appears occluded and the new image appears clear, thereby highlighting the new image.

4. The process according to claim 3, wherein the act of drawing the new image further comprises drawing the new image which contains an element requiring a user's input.

5. The process according to claim 4, further comprising:

receiving input from the user;

processing the input from the user; and drawing a full screen image on the EPD.

6. The process according to claim 5, wherein the full screen image includes the initial state of each of the plurality of pixels of the EPD.

7. The process according to claim 5, wherein the full screen image includes pixel states different from the initial state of each of the plurality of pixels of the EPD.

8. The process according to claim 1, wherein an initial image is displayed, the process further comprising drawing the new image over a portion of the initial image, wherein the pixels driven to the black state and the pixels that retain their initial state do not include pixels in the new image.

9. A process for controlling an electronic paper display (EPD), the EPD comprising a plurality of pixels, the process comprising the acts of:

determining a need for resetting a state of the plurality of pixels;

driving a first subset of the plurality of pixels to a black state;

driving a second subset of the plurality of pixels to a white state; and driving the plurality of pixels to a target state after they have been driven to the black or white state.

10. The process according to claim 9, further comprising determining an initial state of each of the plurality of pixels;

wherein the act of driving the plurality of pixels to the target state further comprises driving the plurality of pixels to their initial state.

11. The process according to claim 9, further comprising determining an initial state of each of the plurality of pixels;

wherein the act of driving the plurality of pixels to the target state further comprises driving the plurality of pixels to a state different from their initial state.

12. A system for controlling an electronic paper display (EPD) comprising:

an EPD display;

control circuitry that control operation of the system;

a display buffer coupled to the control circuitry, the display buffer receiving pixel data from the control circuitry; and the EPD being coupled to the display buffer, the EPD displaying pixel data read from the display buffer, wherein the control circuitry is operable to:

determine an initial state of the pixels in the display buffer, write pixel data to the display buffer that drives a pattern of less than all of the plurality of pixels of the EPD to a black state, and wherein pixels which are not driven to the black state retain their initial state, wherein the pixels driven to the black state and the pixels that retain their initial state form a background image, and write pixel data to the display buffer that draw a new image over a portion of the background image, the pixels comprising the new image containing pixel states that are different from their initial states.

13. The system according to claim 12, wherein the control circuitry is further operable to drive alternating pixels to the black state when driving the pattern of less than all of the plurality of pixels of the EPD to the black state.

14. The system according to claim 12, wherein the control circuitry is further operable to draw the new image containing an element requiring a user's input.

15. The system according to claim 14, further comprising:

input/output circuitry coupled to the control circuitry;

wherein the control circuitry is further operable to:

receiving input from the user via the input output circuitry;

process the input from the user; and draw a full screen image on the EPD.

16. The system according to claim 15, wherein the full screen image includes the initial state of each of the plurality of pixels of the EPD.

17. The system according to claim 15, wherein the full screen image includes pixel states different from the initial state of each of the plurality of pixels of the EPD.

18. The system according to claim 12, wherein an initial image is displayed, the control circuitry is further operable to draw the new image over a portion of the initial image, wherein the pixels driven to a black state and the pixels that retain their initial state do not include pixels in the new image.

* * * * *